US007117625B2

(12) United States Patent
Pikielny

(10) Patent No.: US 7,117,625 B2
(45) Date of Patent: Oct. 10, 2006

(54) HOLSTER WITH ACCESSORIES MOUNTING RAIL

(76) Inventor: Dov Pikielny, 7 Dav Hoz Street, Herzliya, 46581 (IL)

( * ) Notice: Subject to any disclaimer, the term of this patent is extended or adjusted under 35 U.S.C. 154(b) by 162 days.

(21) Appl. No.: 10/842,480

(22) Filed: May 11, 2004

(65) Prior Publication Data

US 2005/0268518 A1 Dec. 8, 2005

(51) Int. Cl.
*F41A 15/00* (2006.01)

(52) U.S. Cl. ..... 42/90; 42/106; 224/193; 224/243; 224/238; 224/911; 224/912

(58) Field of Classification Search ..... 224/192, 224/193, 198, 243, 244, 238, 911, 912; 42/90, 42/106

See application file for complete search history.

(56) References Cited

U.S. PATENT DOCUMENTS 5,166,459 A 11/1992 Stahle et al.
5,562,459 A 10/1996 Durlach et al.
6,267,279 B1 7/2001 Matthews
6,698,129 B1 3/2004 Hanks
6,886,725 B1 * 5/2005 Lowe et al. ..... 224/243
2004/0068913 A1 4/2004 Solinsky et al.
2005/0205621 A1 * 9/2005 Shults ..... 224/198
2005/0224537 A1 * 10/2005 Rassias ..... 224/243

* cited by examiner

*Primary Examiner*—J. Woodrow Eldred
(74) *Attorney, Agent, or Firm*—Dekel Patent Ltd.; David Klein

(57) ABSTRACT

A holster with a light rail affixed thereto. The light rail may include a plurality of ridges spaced from one another along a rail axis, the ridges being separated by grooves that are transverse to the rail axis.

3 Claims, 12 Drawing Sheets

HOLSTER WITH ACCESSORIES MOUNTING RAIL

FIELD OF THE INVENTION

The present invention relates generally to holsters for firearms, and particularly to a holster with a mounting rail for mounting thereto accessories, such as but not limited to, a weapons light, flashlight, laser device, telescopic sight and others.

BACKGROUND OF THE INVENTION

Many weapon manufacturers today manufacture and market weapons with provisions for mounting a light on the weapon. For example, the major handgun manufacturers, such as Springfield Armory, Glock, SIG and many others, make handguns with a light mounting rail formed on the pistol/Rifle frame, such as on the underside or top or both sides of the barrel. Such a mounting rail is often referred to in the art as a "light rail" (or a "Picatinny rail", or "universal rail", or "tactical rail", the terms being used interchangeably throughout the specification and claims). The light rail has been used for mounting whitelights, infrared and laser illuminating devices and telescopic sights, for example. Leading flashlight companies, such as SureFire and Insight Technology make different kinds of lights for mounting on rifles/handguns. Light rails are extensively used by the military, law enforcement SWAT teams, as well as by civilians. Light rails have been provided for a variety of weapons, such as handguns, shoulder-fired weapons, shotguns and rifles (e.g. M1A, M16, AR15 & MP5's).

A typical light rail design is described in U.S. Pat. No. 5,881,486, wherein a longitudinal rail is integrally formed on the top of the weapon casing (along the barrel portion) and on the casing extension as a mounting for a telescopic sight. The longitudinal rail has a dovetail profile on which two clamps are guided that hold the telescopic sight. The longitudinal rail has grooves in the transverse direction at specific intervals. These grooves offer space for clamping screws that fix the clamp. This allows the optical axis of the telescopic sight to be positioned very close to the barrel axis.

Most holsters are designed in such a way that one can not place a handgun in the holster without dismantling the light or other accessory from the light rail. If the light or other accessory is dismantled from the light rail, then a specific accessory is required, e.g., in order to carry the light/accessory on a belt.

SUMMARY OF THE INVENTION

The present invention seeks to provide an improved holster with one or more mounting rails (top hand, bottom hand, and sides) for accessories, such as but not limited to, a weapons light, flashlight, laser device, telescopic sight and others, as is described in detail further hereinbelow.

There is thus provided in accordance with an embodiment of the present invention apparatus including a holster with a light rail affixed thereto. The apparatus may include one or more of the following features. For example, the light rail may include a plurality of ridges spaced from one another along a rail axis, the ridges being separated by grooves that are transverse to the rail axis. The holster may include a casing with a volume or aperture adapted for receiving a weapon therein, the volume/aperture defining a longitudinal axis, and wherein the light rail is generally parallel to the longitudinal axis. The light rail may be positioned on a portion of the casing corresponding to a position of an underside and/or topside of a barrel of a weapon placed in the holster. One or more accessories may be mounted on the light rail, such as but not limited to, a non-coherent light device, a coherent light device, a telescopic sight, and/or an outdoors sport device.

A weapon lock may be provided in the holster, adapted for locking a weapon received in the holster. The weapon lock may include a locking element arranged for selectively moving into locking engagement with a light rail mounted on the weapon disposed in the holster.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
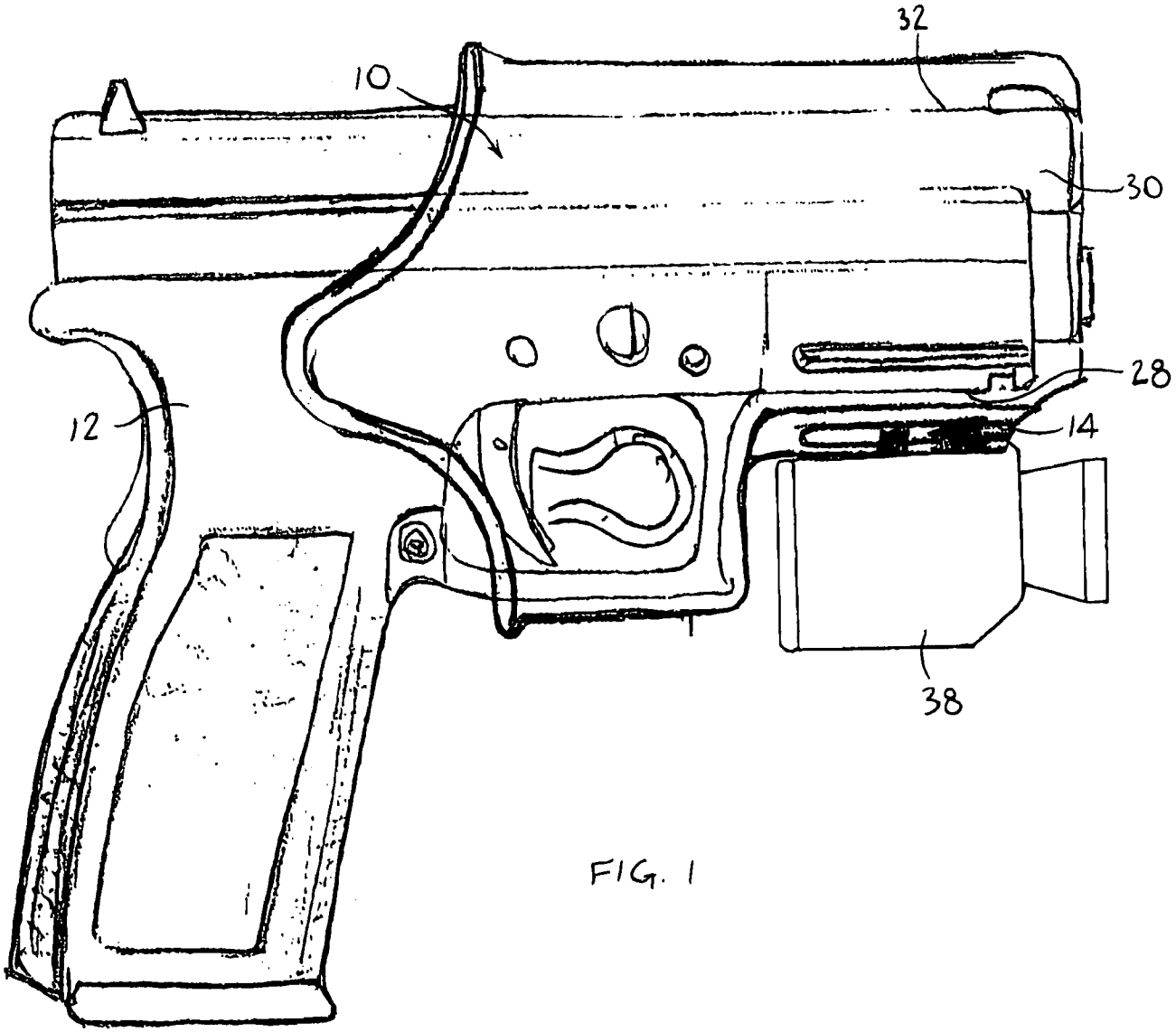
FIG. 1 is a simplified pictorial illustration of a holster with a light rail, constructed and operative in accordance with an embodiment of the present invention, with a weapon disposed in the holster and an accessory (e.g., weapon light) mounted on the light rail of the holster.
Figure 2A:
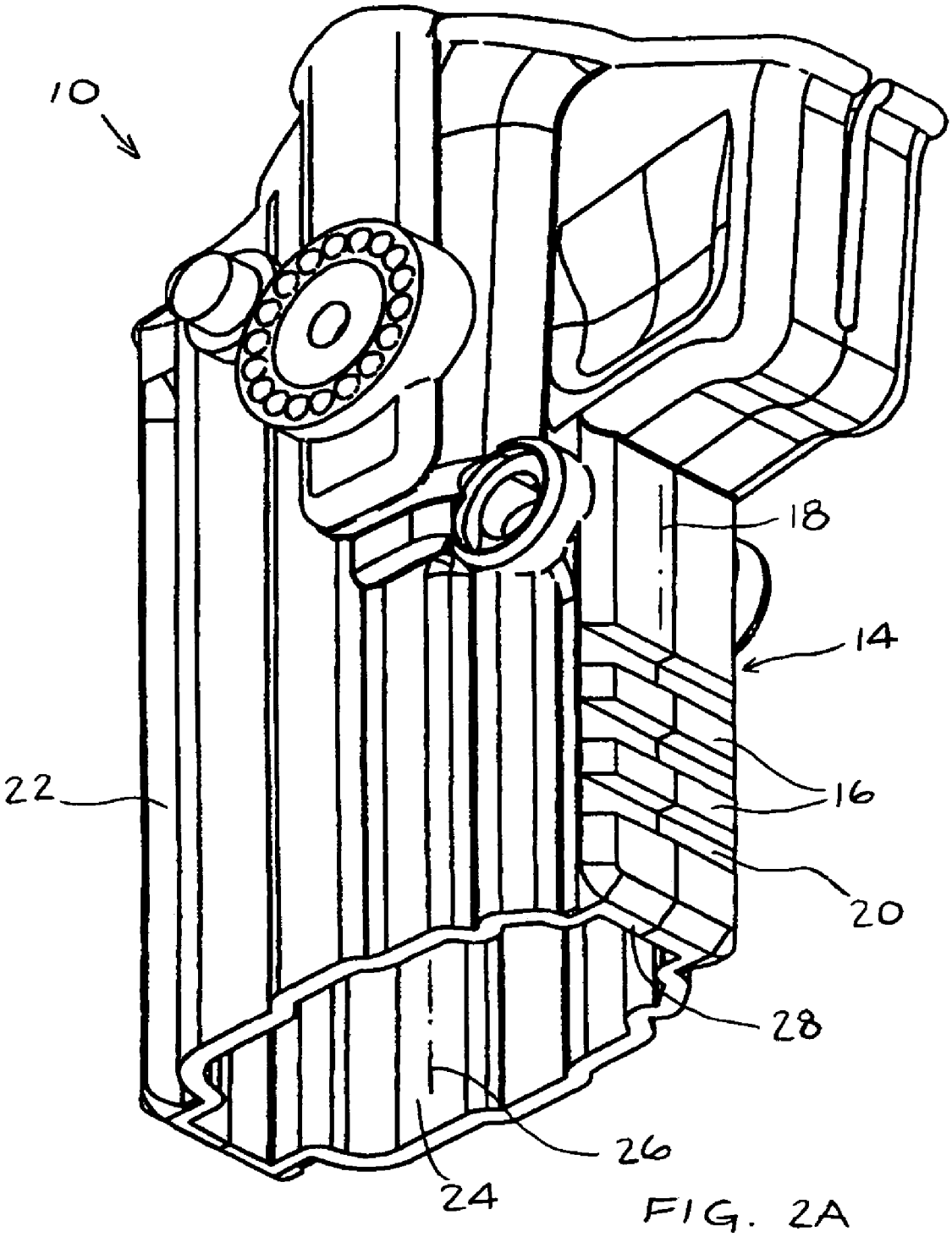
FIGS. 2A, 2B and 2C are simplified perspective, side view and bottom view illustrations, respectively, of the holster of FIG. 1.
Figure 2B:
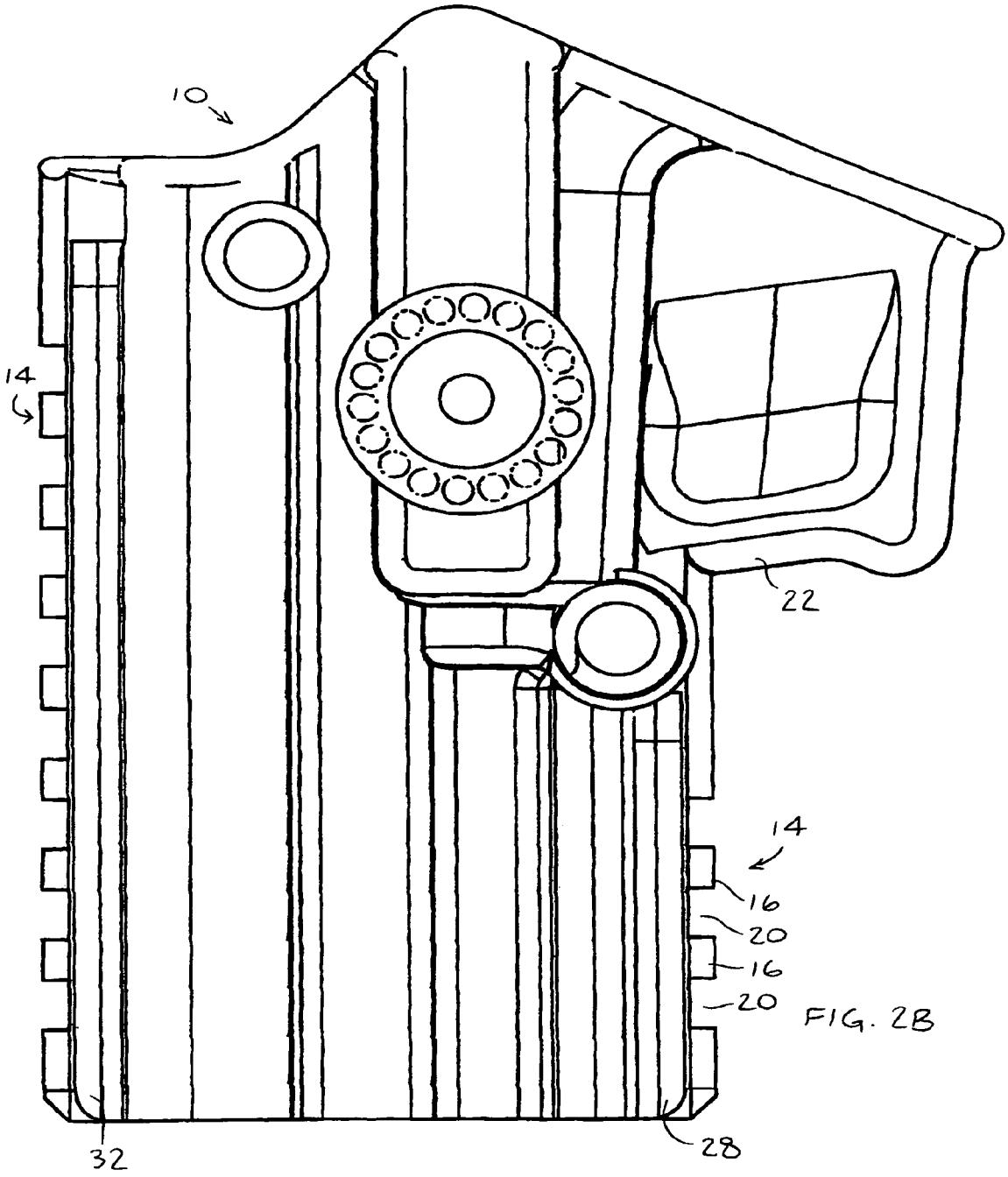
Figure 2C:
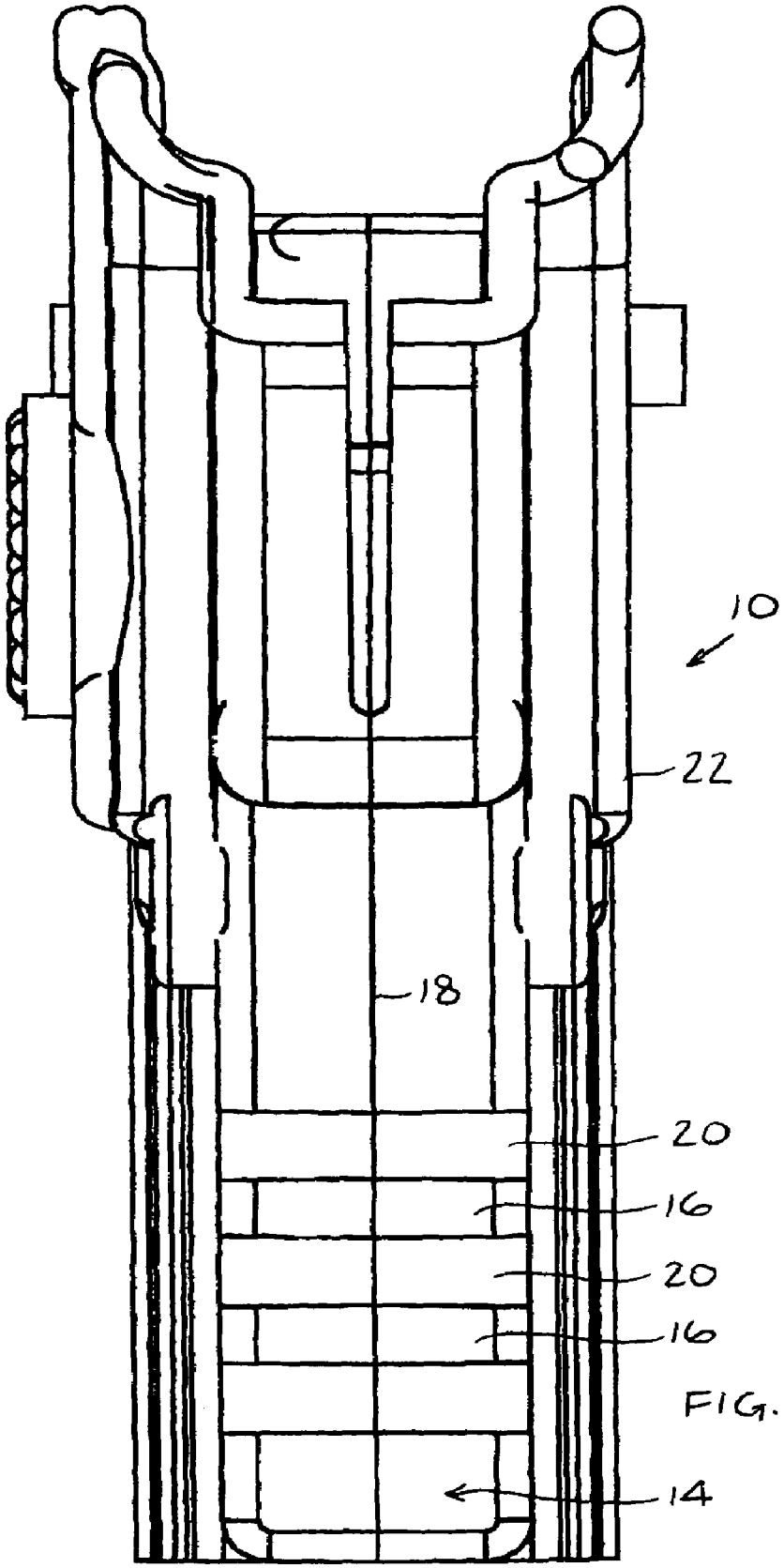

Reference is now made to FIGS. 1–2C, which illustrates a holster 10, constructed and operative in accordance with an embodiment of the present invention.

The holster 10 may be constructed of any suitable material, such as but not limited to, natural or synthetic leather, plastics, carbon-fiber composites, and the like. The holster 10 is shown in FIG. 1 with a weapon 12 disposed therein, e.g., a Springfield Armory model XD or any other handgun. However, the invention is not limited to handguns, and may be carried out with any kind of weapon, such as but not limited to, shoulder-fired weapons, shotguns and rifles (e.g., M1A, M16, AR15 & MP5's).

In accordance with an embodiment of the present invention, holster 10 has a light rail 14 affixed thereto. In the non-limiting illustrated embodiment, light rail 14 may have a plurality of ridges 16 spaced from one another along a rail axis 18. The ridges 16 may be separated by grooves 20 that are transverse to the rail axis 18. The light rail 14 may have any profile, such as but not limited to, a dovetail profile. The light rail 14 may be constructed in accordance with standardized light rails, such as but not limited to, the Picatinny mounting platform or any kind of universal mounting rail.

It is noted that the term "light rail" (or a "Picatinny rail", or "universal rail", or "tactical rail", the terms being used interchangeably throughout the specification and claims) as used in the description and the claims, encompasses any kind of mounting rail for accessories, not just lights. Examples of accessories are given hereinbelow.

Holster 10 may include a casing 22 with a volume 24 adapted for receiving the weapon 12 therein. The volume 24 may define a longitudinal axis 26. In the non-limiting illustrated embodiment, light rail 14 is generally parallel to longitudinal axis 26.

The light rail 14 may be positioned on a portion of casing 22 corresponding to a position of an underside 28 of a barrel 30 of weapon 12. Additionally or alternatively, the light rail 14 may be positioned corresponding to a topside 32 of barrel 30. However, the invention is not limited to these positions, and light rail 14 may be mounted on any other portion of holster 10.

Figure 3:
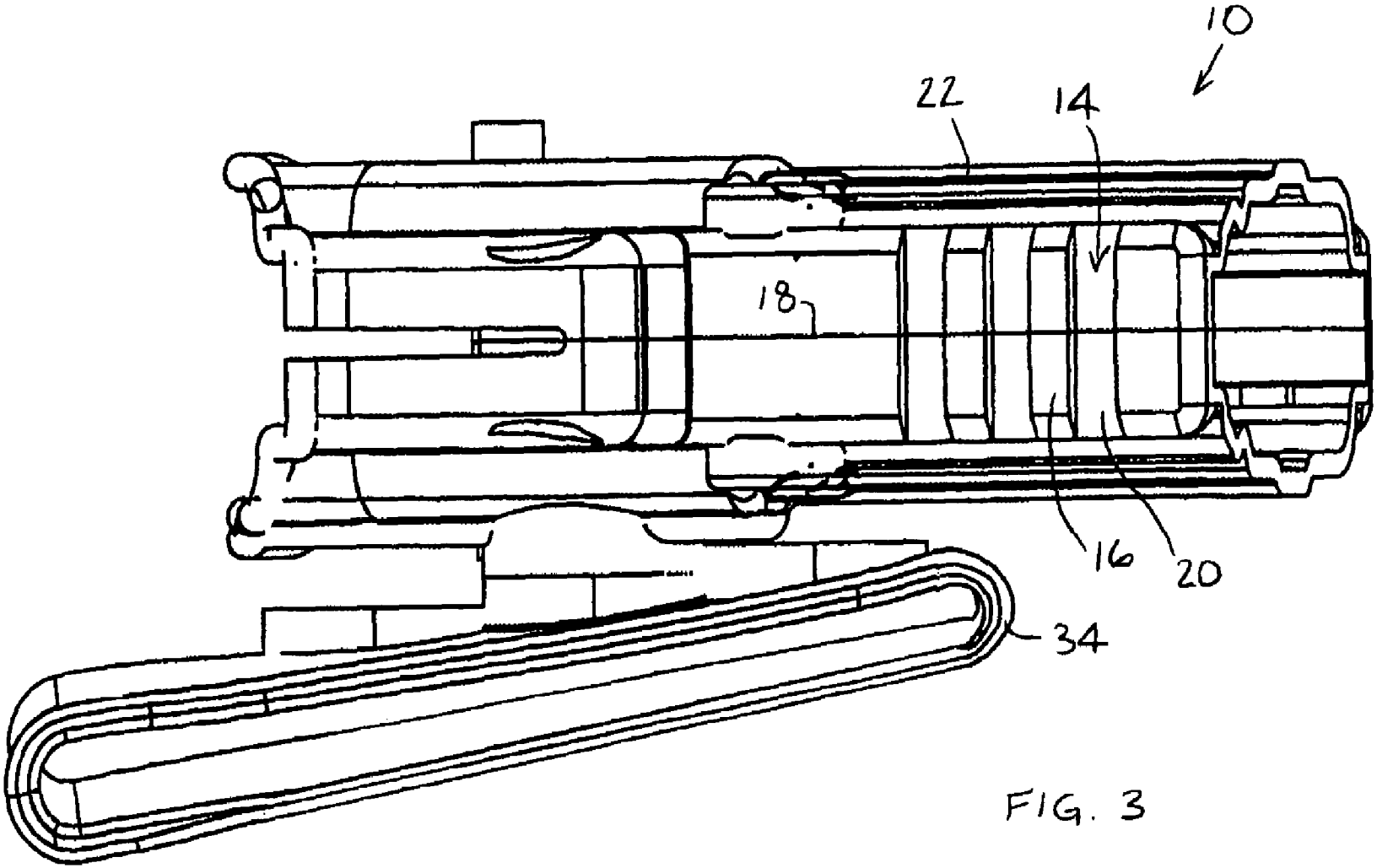
FIG. 3 is a simplified pictorial illustration of the holster of FIG. 1 with a belt-mounting device, in accordance with an embodiment of the present invention.
Figure 4:
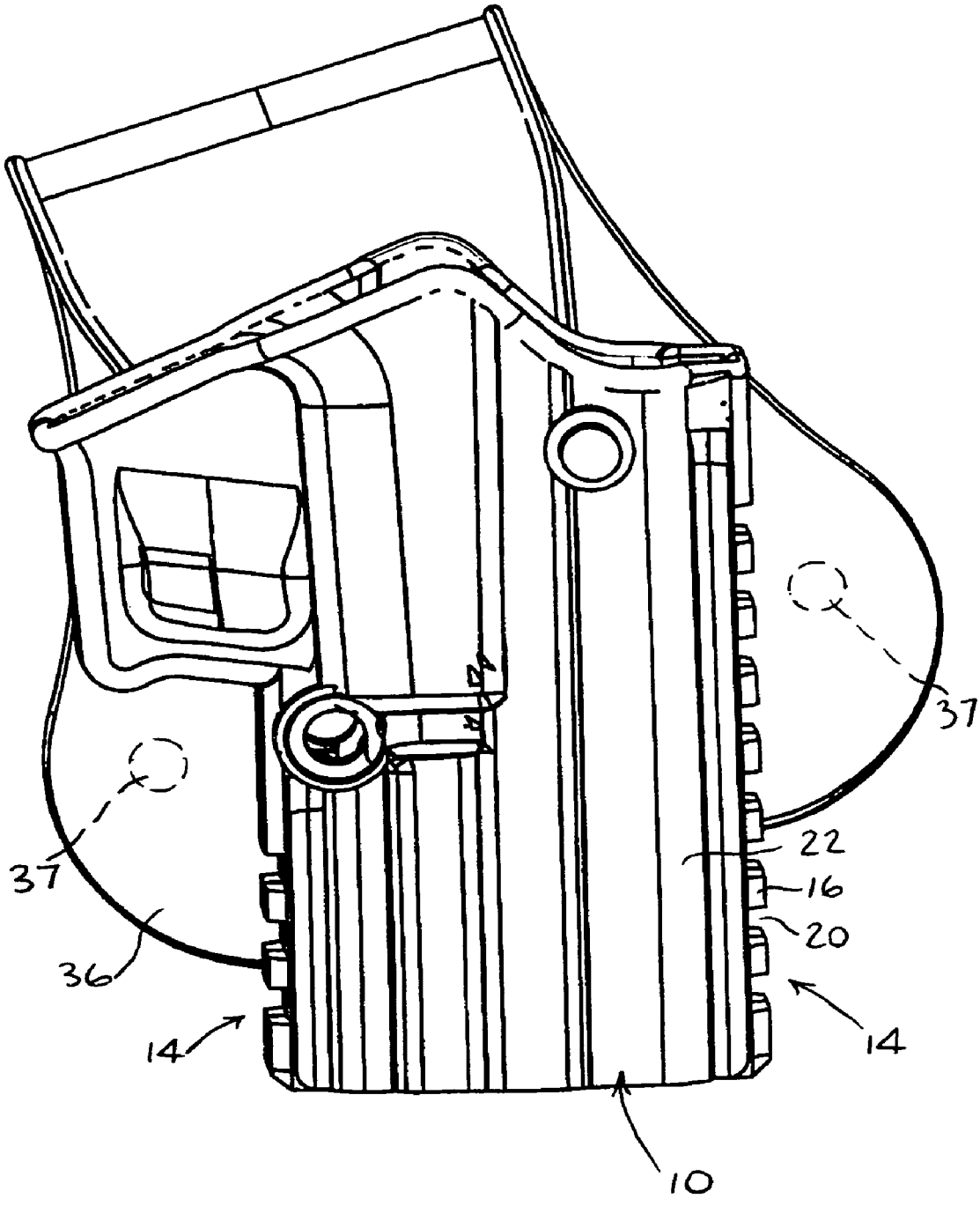
FIG. 4 is a simplified pictorial illustration of the holster of FIG. 1 with a paddle, in accordance with an embodiment of the present invention.

Reference is now made to FIG. 3, which illustrates holster 10 with a belt-mounting device 34, in accordance with an embodiment of the present invention. The belt-mounting device 34 may include, for example, a belt clip for clipping on to a belt, or a belt loop through which a belt may be slipped for a variety of belt widths Reference is now made to FIG. 4, which illustrates holster 10 with a paddle 36, in accordance with an embodiment of the present invention. As is well known in the art, paddle 36 may ride securely in a waistband of a user (not shown). Paddle 36 may be provided with mounting studs 37 of different sizes and configurations, which permit adjusting the paddle 36 with respect to the holster 10 linearly (e.g., vertically and/or horizontally) and/or rotationally (e.g., in the plane of the paddle and/or out of the plane of the paddle).

As mentioned before, many kinds of accessories may be mounted on the light rail 14. The way in which the accessory attaches to the light rail 14 may be the same or similar to the way weapons lights (like those of SureFire and Insight Technology) attach to handguns, such as with spring-loaded lugs (not shown) that are held at the ridges 16 or grooves 20 of the light rail 14, as is well known in the art, and which does not require further description for the skilled artisan. FIG. 1 illustrates a non-coherent light device 38 mounted on the light rail 14, such as, but not necessarily, a SureFire weapon light, which is a two-battery, rail-mounted tactical light, with a grip-activated momentary switch and a constant-on shuttle switch.

Figure 5:
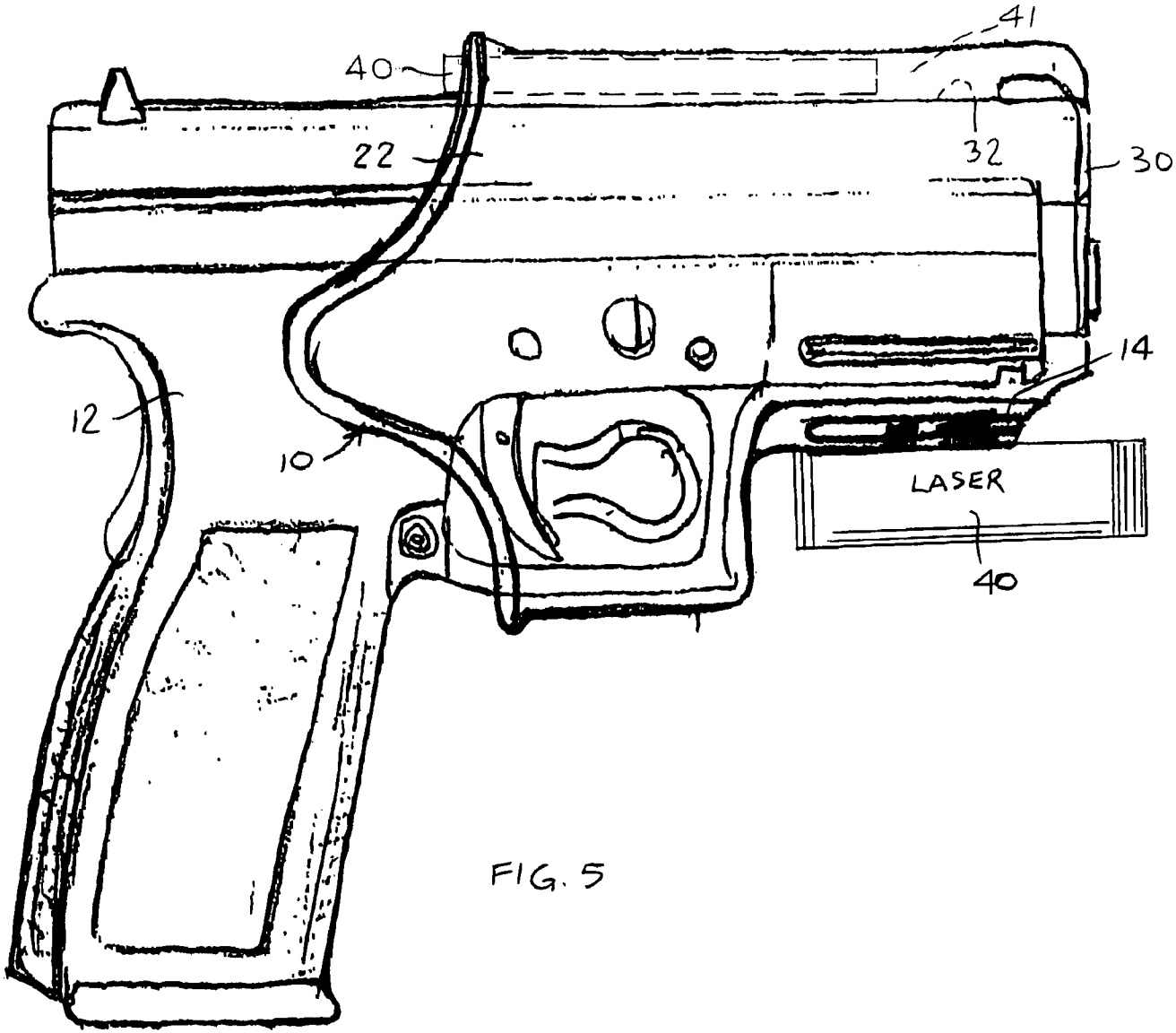
FIGS. 5, 6 and 7 are simplified pictorial illustrations of other accessories mounted on the light rail of the holster of FIG. 1, namely, a laser device, a telescopic sight, and an outdoors sport device, respectively.
Figure 6:
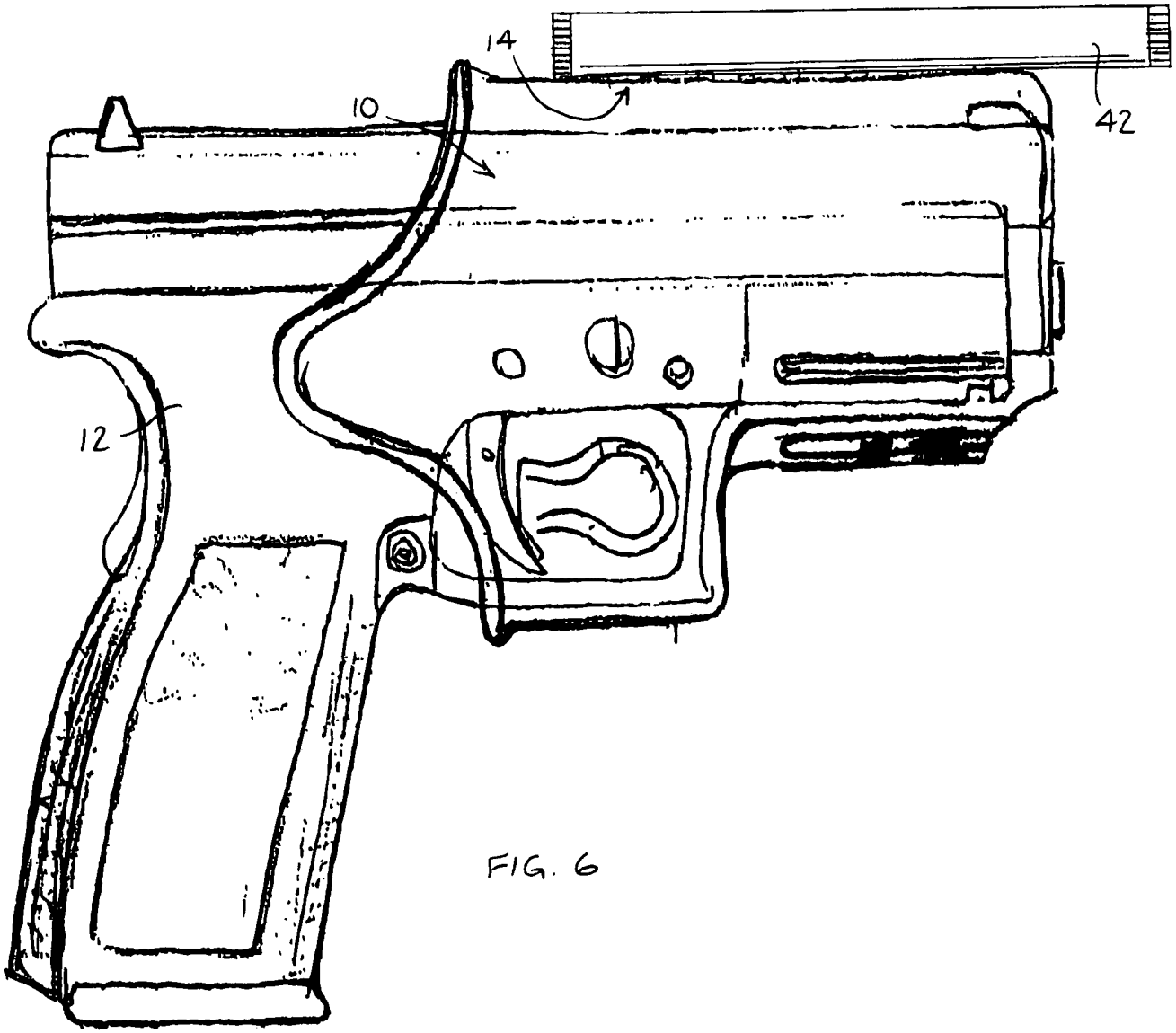
Figure 7:
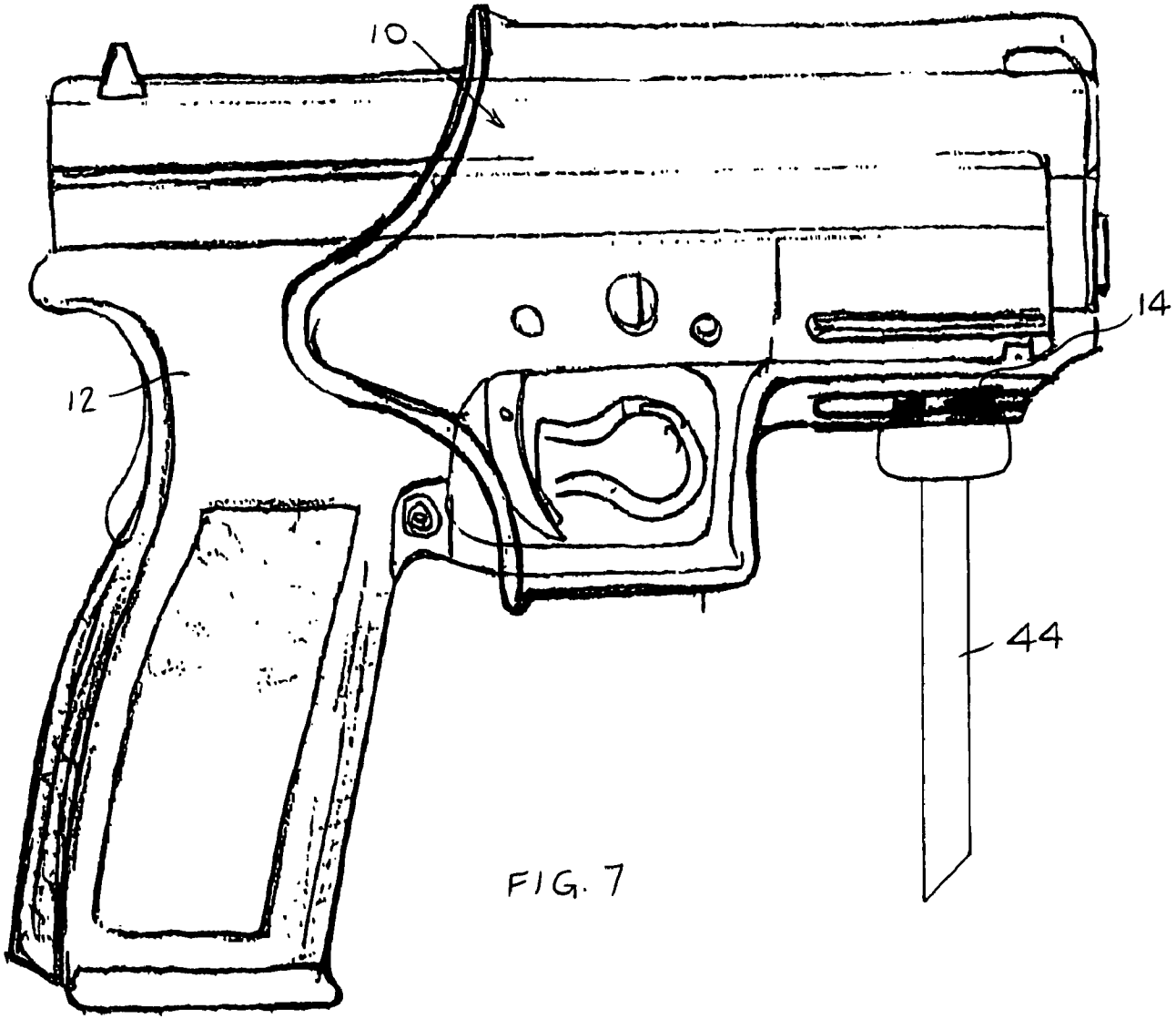

Reference is now made to FIGS. 5, 6 and 7, which illustrate just some non-limiting examples of accessories mounted on the light rail 14. In FIG. 5, an optical weapon device 40, such as but not limited to, a coherent light device (e.g., laser aiming or pointing device) is mounted on light rail 14. It is also seen that casing 22 of holster 10 may be sized such that a space 41 is formed between casing 22 and topside 32 of barrel 30. Another optical weapon device 40 may be optionally inserted in space 41, and may be mounted, for example, on a light rail (not shown) on topside 32. In FIG. 6, a telescopic sight 42 is mounted on light rail 14. In FIG. 7, an outdoors sport device 44, such as a mounting climbing tool, is mounted on light rail 14.

Figure 8:
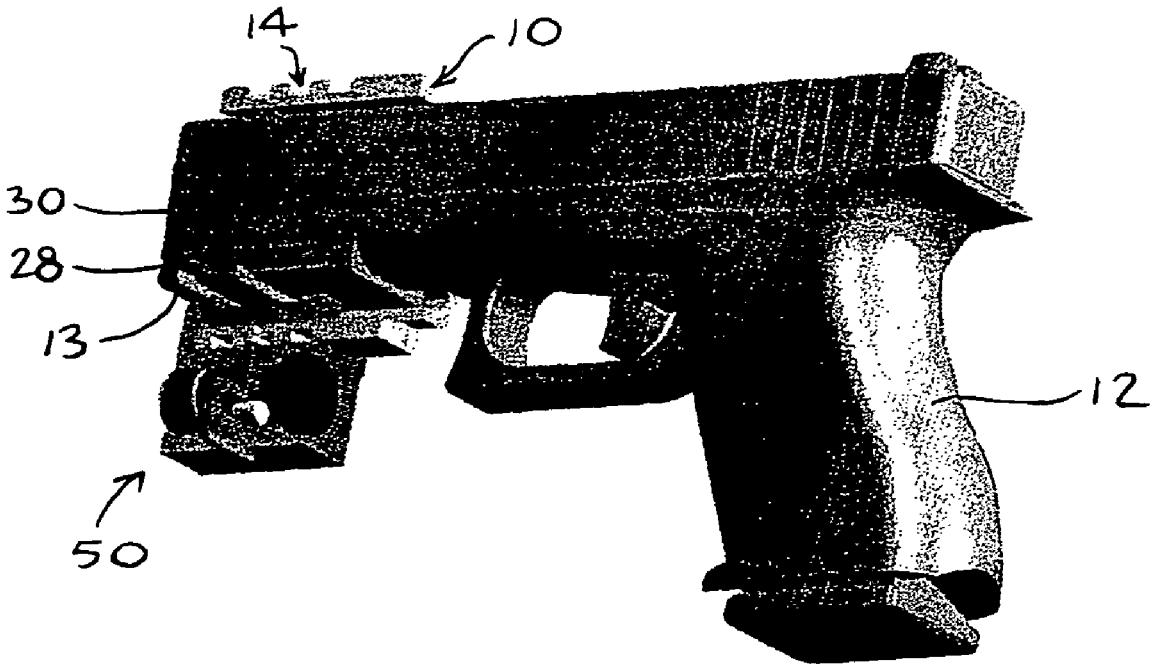
FIG. 8 is a simplified pictorial, partially cutaway illustration of a weapon lock used with the holster of FIG. 1, constructed and operative in accordance with an embodiment of the present invention.
Figure 9:
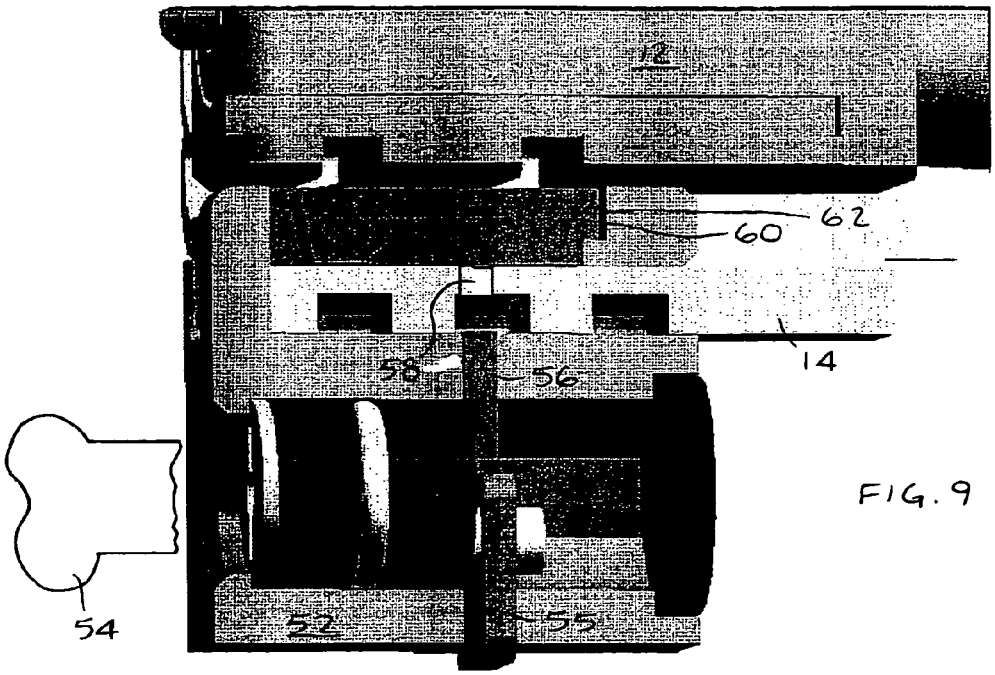
FIGS. 9 and 10 are more detailed illustrations of the weapon lock of FIG. 8, in respective unlocked and locked orientations, in accordance with an embodiment of the present invention.
Figure 10:
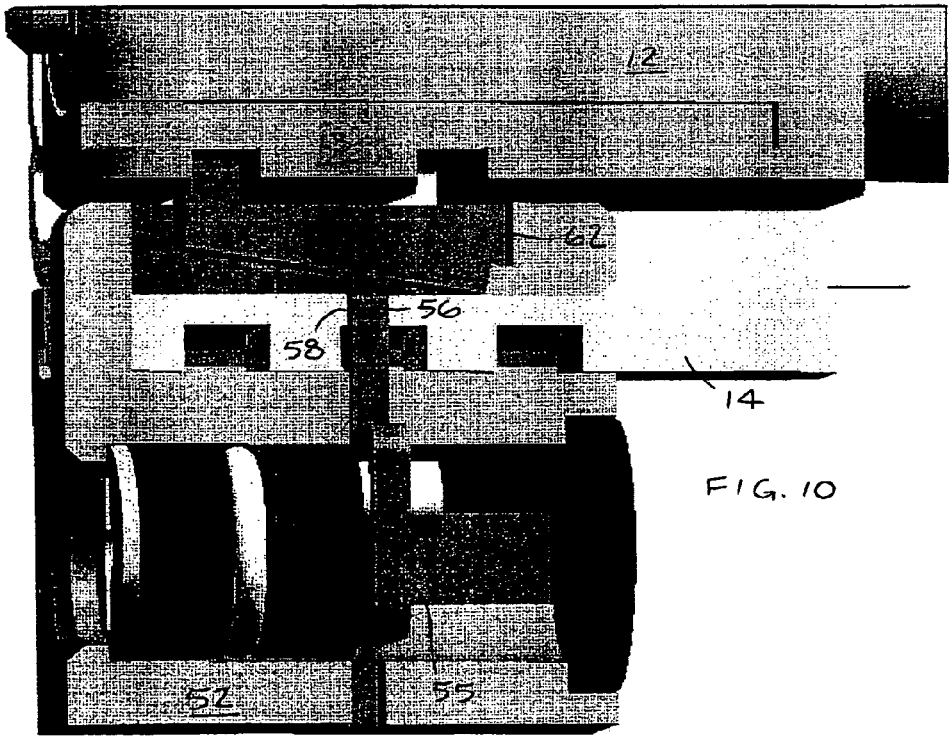

Reference is now made to FIGS. 8–10, which illustrate a weapon lock 50, used with holster 10, constructed and operative in accordance with an embodiment of the present invention.

It is noted that there are many kinds of weapon locks used today, such as but not limited to, a lock developed and patented by Springfield, Inc. for the 1911 pistols, and patented as U.S. Pat. No. 6,691,445 to Charles David Williams. One example of the many kinds of weapon locks is a hammer deactivation device, which allows a user manually to lower the handgun's hammer into a deactivated position, and which must be manually re-toggled in order to re-cock the hammer before the handgun can be fired. A key activated trigger lock prevents pulling the trigger of the weapon without first removing the trigger lock by use of the trigger lock's key. A combination trigger lock prevents pulling the trigger of the weapon without first dialing or pressing numbers of the combination lock to enable removing the lock. A passive use-limitation device is a device that automatically resets itself so that an unauthorized user cannot fire the weapon. (A key activated trigger lock, for example, is not a passive use-limitation device because it needs to be re-locked manually after its key is used to unlock it.) A solenoid use-limitation device uses a magnetically activated relay that interacts with a magnet of predefined strength worn on the user's gun hand to permit firing the weapon.

The above are examples of locks designed to foil unauthorized persons from firing the weapon. Another family of devices includes childproofing or other safety devices, which are not designed to foil unauthorized persons, rather are designed to prevent youngsters (such as but not limited to, six years of age or younger) from using the weapon. Examples of such devices include locks similar to key-operated locks or combination locks, but instead of a key or combination, are opened or otherwise activated by pushing a button or turning a knob or any other action which is too difficult for a child to perform.

The description follows for a key-operated weapon lock. However, it is emphasized that the weapon lock 50 of the present invention may include any of the above described locks, childproofing or other safety devices, and is not limited to any particular type of device.

In accordance with an embodiment of the present invention, weapon lock 50 is disposed in holster 10 and adapted for locking the weapon 12 while received in holster 10.

Weapon lock 50 may include a key-operated cylinder lock 52. Cylinder locks are well known in the art, and do not require a detailed description to the skilled artisan. Briefly, without showing details in the drawing, cylinder locks generally include a plug (also called tumbler) arranged for rotation in a lock cylinder housing. Plug pins are slidingly disposed in the plug and are arranged to move against driver pins, which are disposed in bores formed in the cylinder housing and are spring biased toward the axis of the plug rotation. Insertion of a properly cut key in a keyway provided in the plug moves the plug pins against the driver pins and aligns all the pins along a shear line defined by the plug outer circumference, thereby permitting rotation of the plug to cause operation of a latch or locking mechanism.

In the non-limiting illustrated embodiment, cylinder lock 52 is positioned in holster 10 just below the light rail 14 that is positioned on the underside 28 of barrel 30 of weapon 12. Weapon 12 has its own light rail 13 on the underside 28 of barrel 30. A key 54 inserted into cylinder lock 52 may permit throwing a cam 55, which includes a tongue 56 that may protrude through a bore 58 formed in the light rail 14. Tongue 56 is adapted to actuate a locking element 60, which is arranged for pivoting motion in a chamber 62, which extends from the cylinder lock housing above the light rail 14 of the holster 10 and below the light rail 13 of weapon 12.

When tongue 56 protrudes through bore 58, as seen in FIG. 10, it pushes locking element 60 into locking engagement with light rail 13 mounted on weapon 12. The way in which locking element 60 engages light rail 13 may be the same or similar to the way weapons lights attach to handguns, such as being fashioned as a spring-loaded lug that clicks into the grooves of the light rail 13, as is well known in the art, and which does not require further description for the skilled artisan. Once locking element 60 engages light rail 13, weapon 12 cannot be removed from holster 10.

Figure 11:
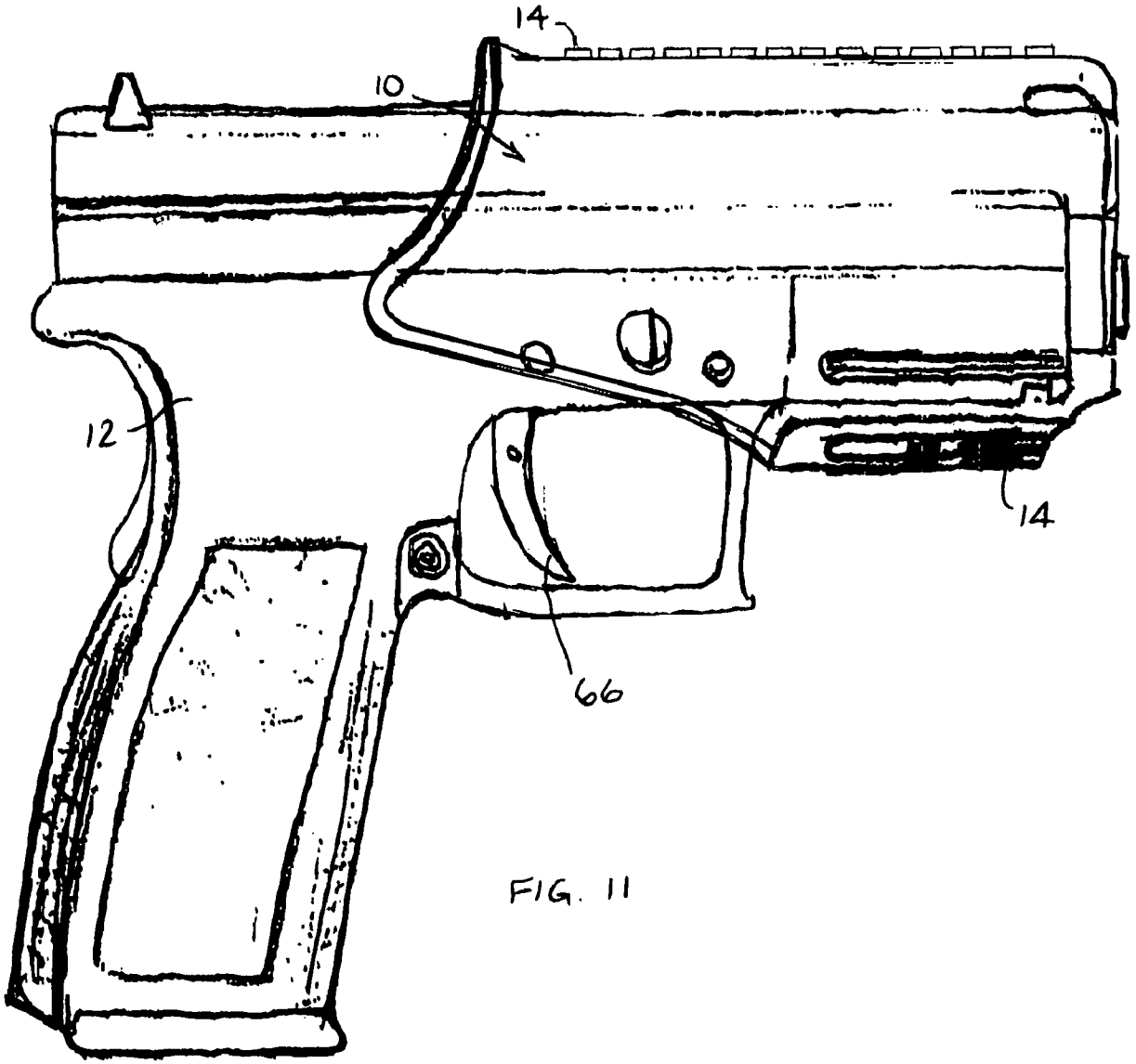
FIG. 11 is a simplified pictorial illustration of the holster of FIG. 1 configured as a mount (adapter), in accordance with an embodiment of the present invention.

Reference is now made to FIG. 11, which illustrates holster 10 configured as a mount (adapter), in accordance with an embodiment of the present invention. In this embodiment, holster 10 is shaped so as not to block or interfere with a trigger 66 of weapon 12. In this manner, holster 10 may be used as a mount (adapter) for mounting lights or other accessories on weapon 12, even if weapon 12 itself is not equipped with light mounting rails.

It is appreciated that various features of the invention which are, for clarity, described in the contexts of separate embodiments, may also be provided in combination in a single embodiment. Conversely, various features of the invention which are, for brevity, described in the context of a single embodiment, may also be provided separately or in any suitable subcombination.

What is claimed is:

1. Apparatus comprising:

a holster with a light rail affixed thereto, wherein said holster includes a casing with a volume adapted for receiving a weapon therein, said volume defining a longitudinal axis, and wherein said light rail is generally parallel to said longitudinal axis, and wherein said light rail is positioned on a portion of the casing corresponding to a position of an underside of a barrel of a weapon placed in the holster.

2. Apparatus comprising:

a holster with a light rail affixed thereto; and a weapon lock disposed in said holster adapted for locking a weapon received in said holster, wherein said weapon lock comprises a locking element arranged for selectively moving into locking engagement with a light rail mounted on a weapon.

3. The apparatus according to claim 2, further comprising a weapon disposed in said holster, said weapon having a light rail mounted thereon.

* * * * *